US006516570B2

(12) United States Patent
Liebetrau et al.

(10) Patent No.: US 6,516,570 B2
(45) Date of Patent: Feb. 11, 2003

(54) ELEVATOR HOISTWAY

(75) Inventors: Christoph Liebetrau, Menziken (CH); Utz Richter, Ebikon (CH)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 09/731,152

(22) Filed: Dec. 7, 2000

(65) Prior Publication Data

US 2001/0003887 A1 Jun. 21, 2001

(30) Foreign Application Priority Data

Dec. 16, 1999 (EP) ..... 99811166

(51) Int. Cl.[7] ..... B66B 9/00
(52) U.S. Cl. ..... 52/30; 187/351; 187/336
(58) Field of Search ..... 52/30, 111, 192; 187/351, 336, 338; 182/141

(56) References Cited

U.S. PATENT DOCUMENTS

| | | | | | |
|---|---|---|---|---|---|
| 407,849 | A | * | 7/1889 | Crofford | 187/336 |
| 420,744 | A | * | 2/1890 | Stevens | 187/338 |
| 431,676 | A | * | 7/1890 | Stanford | 187/338 |
| 969,557 | A | * | 9/1910 | Norris | 187/336 |
| 1,142,405 | A | * | 6/1915 | Derry | 187/336 |
| 3,990,589 | A | * | 11/1976 | Manaugh | 214/16.1 |
| 5,687,816 | A | * | 11/1997 | Wusthof et al. | 187/337 |
| 6,131,702 | A | * | 10/2000 | Berridge | 187/259 |
| 6,202,801 | B1 | * | 3/2001 | Muller et al. | 187/401 |

FOREIGN PATENT DOCUMENTS

| | | |
|---|---|---|
| DE | 42 23 017 | 1/1994 |
| EP | 0 579 024 | 6/1993 |

* cited by examiner

*Primary Examiner*—Carl D. Friedman
*Assistant Examiner*—Naoko Slack
(74) *Attorney, Agent, or Firm*—MacMillan, Sobanski & Todd, LLC

(57) ABSTRACT

An elevator hoistway for a multi-storied building which, to create a vertical travel path for an elevator installation, extends through at least one story floor and has at least one hoistway frame which bounds a hoistway penetration aperture in the story floor is to be post-constructionally created in an existing multi-storied building with little building effort and inexpensive means in that the hoistway penetration aperture can be covered by means of a load-bearing floor structure. In this way, and especially in one-family houses, the volume of the elevator hoistway can be used for non-elevator-specific purposes, e.g. as residential space, until the point in time when an elevator is subsequently installed. The hoistway frame itself serves as an interface between the building and elevator fastenings which may be provided for the transmission of forces.

12 Claims, 4 Drawing Sheets

ELEVATOR HOISTWAY

BACKGROUND OF THE INVENTION

The present invention relates to an elevator hoistway for a multi-storied building which, to create a vertical travel path for an elevator installation, extends through at least one floor, and has at least one hoistway frame which bounds a hoistway penetration aperture in the floor.

Increasingly scarce and costly building land necessitates high-density construction of residential units with multiple stories. To use the residential space in this situation, the difference in height of the individual stories has to be overcome, which creates the problem of vertical transportation. If vertical transportation is provided by an elevator installation, there is generally also only limited space available for the hoistway of the elevator installation. Furthermore, installing an elevator is associated with additional investments that make it necessary for the building owner to consider the benefits in relation to the costs before the residential space is constructed.

Particularly the owners of one-family houses constructed in this manner give precedence to low construction costs and decide initially in favor of less residential space which can then be adapted to changing residential needs after its construction. Overcoming the vertical differences between the stories is such a need that changes during different phases of life. Whereas in younger years vertical transportation by means of adequate physical mobility is of little significance, with increasing age and/or the onset of impaired mobility the unrestricted use of multi-storied one-family houses is inevitably linked to an elevator installation. For the reasons mentioned above, when a one-family house is first constructed it is usual not to provide an elevator installation, and only to construct an elevator installation together with an elevator hoistway in or on the house at great cost when the need arises.

In German patent document DE 42 23 017 A1 there is shown a means of reducing the substantial costs of corresponding constructional measures when elevator hoistways and elevators are installed post-constructionally in multi-storied prefabricated houses that are constructed from prefabricated space cells stacked on top of each other in which an elevator hoistway is precisely prefabricated floorwise in the individual space cells which, when the space cells are stacked on top of and fastened to each other, forms a continuous elevator hoistway. Adjacent to longitudinal walling from space cell to space cell, and flush with it, there are in the floor and ceiling slabs of each space cell rectangular openings which in each case are bounded by a hoistway frame. Steel sections with wall cladding between them extend over three sides between the floor slab and the ceiling slab of a space cell, whereas on the fourth side an elevator door is provided.

By means of the standardized floorwise exact prefabrication of the elevator hoistway in individual modules, the cost of installing an elevator could be reduced, but here too, the decision in favor of an elevator installation and of the costs of constructing the hoistway, as well as the additional building space occupied by the elevator hoistway, still has to be taken into account when the residential unit is constructed. As a result, the building owner is still confronted with high elevator-related costs when the house is planned.

SUMMARY OF THE INVENTION

The purpose of the present invention is to propose an elevator hoistway which can be formed post-constructionally in an existing multi-storied building by simple and inexpensive means.

According to the present invention, in fulfillment of this task an elevator hoistway is proposed, which is particularly distinguished in that the aperture for penetration of the hoistway can be closed by means of a load-bearing floor structure.

The elevator hoistway components anticipatorily provided in the building structure reduce the cost of subsequent installation of an elevator installation, especially of an elevator hoistway, in an existing building. Should the need arise, only the load-bearing floor structure has to be removed, and the penetration, or aperture, for passage of the hoistway through the story floor is created by the hoistway frame which is already in place. This makes the invention particularly suitable for use in one-family houses where, thanks to this load-bearing floor structure, the volume of the elevator hoistway can be used as residential space until the point in time at which the elevator is subsequently installed.

Practically unrestricted utilization of the hoistway volume is achieved with an embodiment of the invention in which the load-bearing floor structure is aligned flush with the story floor, thereby maintaining a continuous plane surface. A simple means of aligning the floor structure is provided by a further embodiment, in which the hoistway frame can be adjusted in the vertical direction to the thickness dimension of the respective story floor.

The hoistway frame can serve as a force-transmitting interface between the load-bearing floor structure or, where an elevator has been installed, the suspension and guide equipment on the one hand, for example, and the story floor on the other hand, if the hoistway frame has anchoring means with which it can be connected into the load-bearing structure of the story floor.

In a preferred embodiment according to the invention, the floor structure is constructed as an insertable frame and inserted into the hoistway frame as a prefabricated component. Beside simple insertion into and removal from the hoistway frame, this embodiment affords great freedom in relation to the construction and form of the floor structure. In addition, the insertable frame component opens up the possibility of supporting the floor structure swimming in the floor surface, to compensate stresses or movements of the floor surfaces relative to the respective hoistway frames.

An especially preferred embodiment of the invention also envisages a hoistway frame non-positively anchored in the story floor which creates in the hoistway a vertical supporting structure extending over the entire travel path which can be connected to the hoistway frame, and to which the load-bearing floor structure is detachably attached. In addition to the load-bearing floor structure, the vertical supporting structure can also serve to have fastened to it, for example, hoistway doors and/or hoistway walls, shelves, or even prefabricated modules with an integrated floor capable of being linked to the structure.

The latter is part of a flexible concept achieved by means of the vertical structure for temporary utilization of the building space planned for the elevator. Its utilization can be adapted to the needs of the residents of the house as the residents' needs change over their lifetime. With corresponding integration into the elevator hoistway of domestic water supply, drainage, and electric power supply, a prefabricated module can be formed as a sanitary unit which can be coupled to the vertical supporting structure and which contains, for example, a shower, toilet, and similar items.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
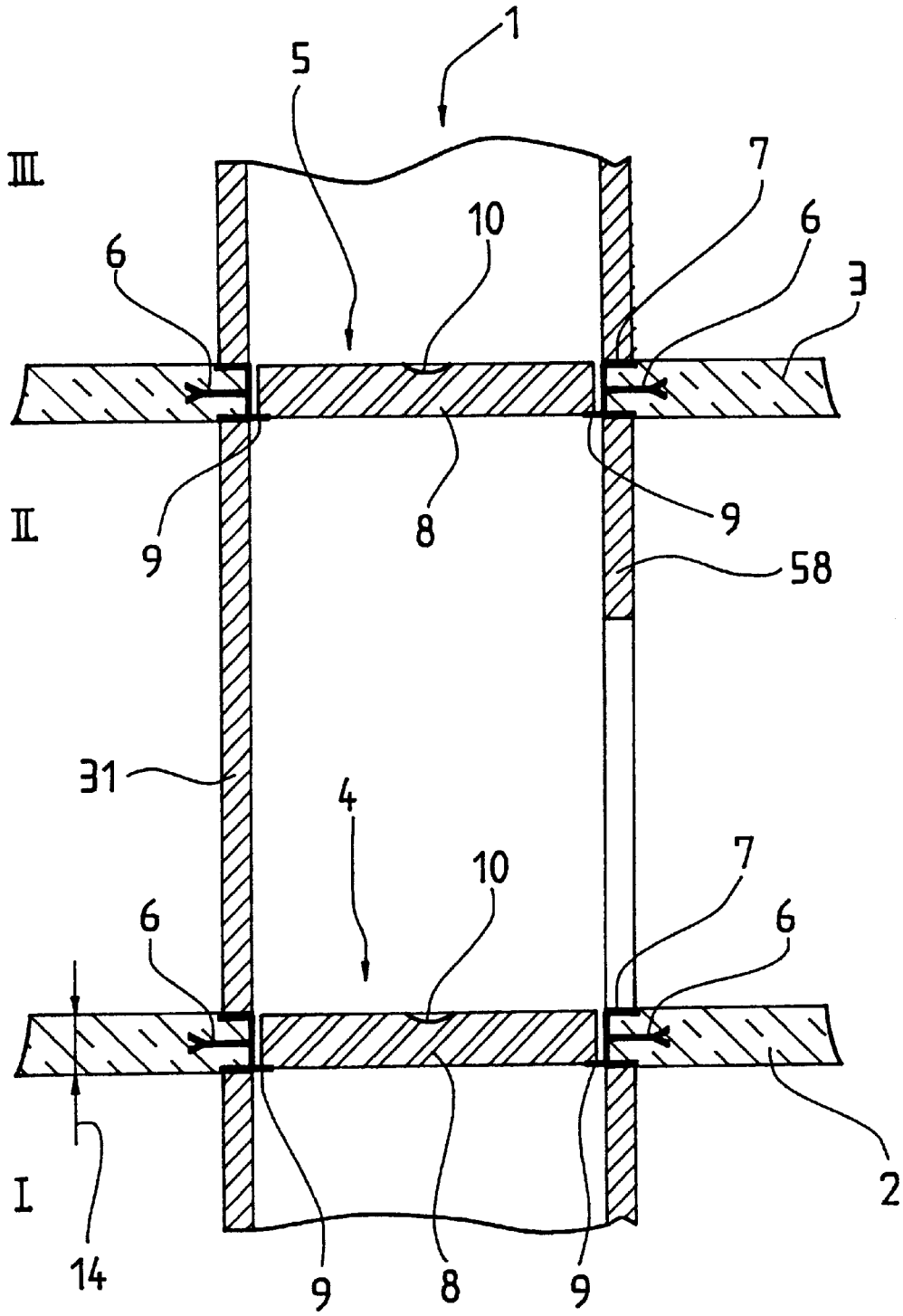
FIG. 1 is a vertical cross-sectional view of an elevator hoistway frame according to the present invention.

In the description relating to FIGS. 1 to 6 that follows, corresponding constructional elements are indicated with the same reference number. FIG. 1 shows a longitudinal section through part of an elevator hoistway 1 according to the invention extending over three stories. The elevator hoistway 1 was constructed over the respective stories I, II and III in a building when the building was constructed, and so as to create a vertical travel path for an elevator installation which will be post-constructionally installed in the elevator hoistway. In anticipation of this, in a floor 2 of the story II and in a floor 3 of the story III rectangular hoistway penetration apertures 4 and 5 respectively have been made which are aligned above each other and have the size of the desired cross-section of the hoistway and which are bounded by hoistway frames 7 permanently fastened in the respective story floor structure in conventional manner by means of tie rods 6 or similar devices. Instead of the hoistway frames 7 being rectangular, they can also have a square, triangular, oval, or other suitable shape as desired.

According to the invention, each hoistway penetration aperture 4 and 5 is covered by a load-bearing cover 8, which is detachably fastened to the hoistway frame 7. Here, the cuboid load-bearing floor cover 8 lies on rail sections 9 of the hoistway frame 7 that project into the elevator hoistway 1. The load-bearing floor cover 8 is formed suitably to close the hoistway penetration aperture 4 and 5 in a largely sound- and heat-insulating manner; it remains virtually as part of the story floor 2 and 3 in the hoistway frame 7 and is only removed for subsequent installation of an elevator installation. The floor cover 8 is shown here in its simplest embodiment as a monolithic concrete cover, which is fitted at least with an installation loop 10 as known, for example, from shaft covers. The suspension element of, for example, a lifting crane is hooked onto the installation loop 10, or loops, when the floor cover 8 is moved or removed. The floor cover 8 itself can either be inserted into the hoistway frame 7 prefabricated, or else formed together with the story floor 2 and 3 when the building is constructed. In the latter case, the hoistway frame 7 is inserted into the story floor, or more specifically, the concrete formwork, fixed in place, and joined to the reinforcement; correspondingly, to produce the requisite load-bearing capacity of the concreted floor cover 8 it is given steel reinforcement, over the entirety of which concrete is then poured. Alternative embodiments of load-bearing floor structures are known to the specialist. Selected individual preferred exemplary embodiments are presented below.

Figure 3:
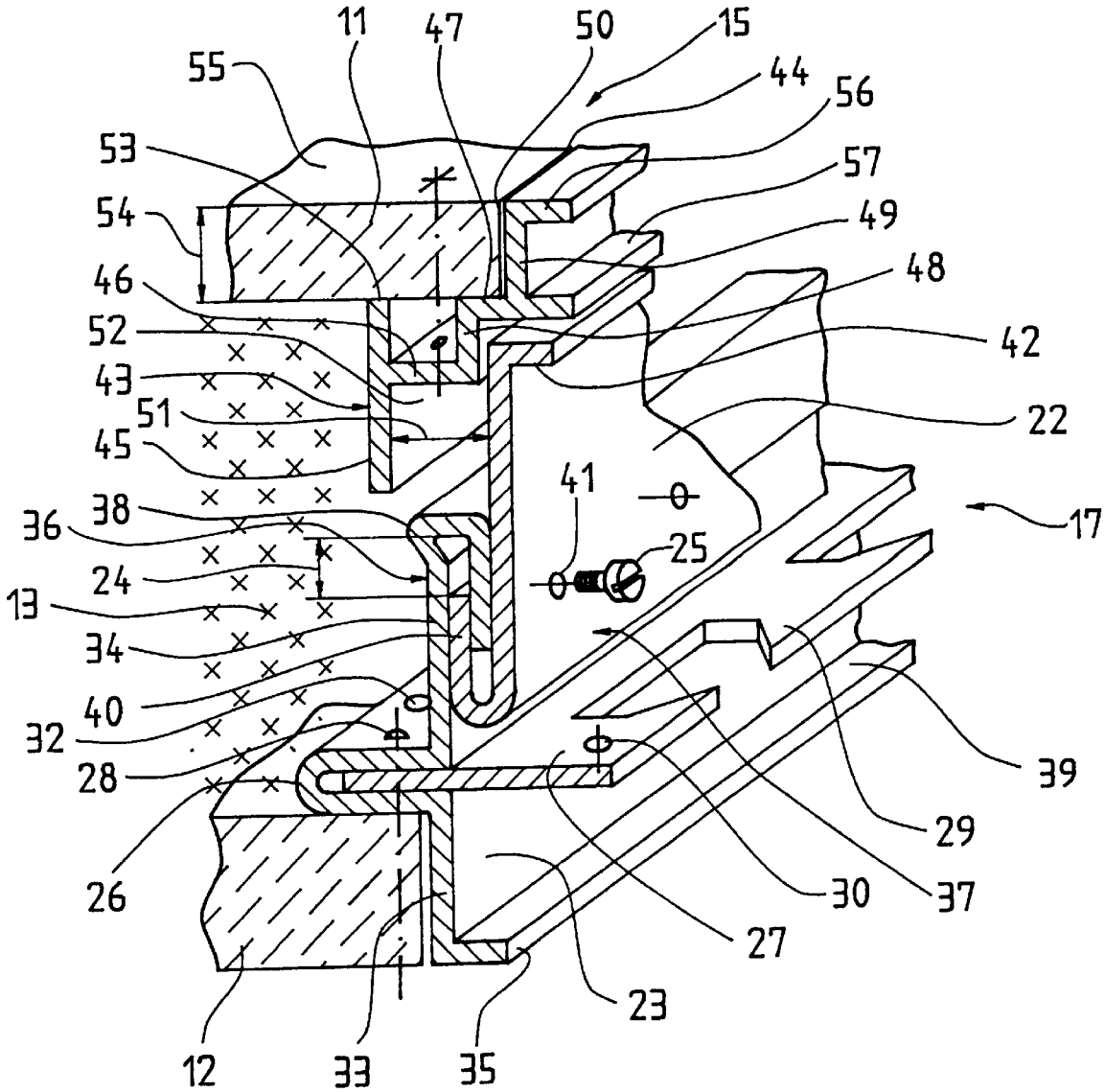
FIG. 3 is an enlarged partial cross-sectional view of an adjustable hoistway frame with insertable frames according to the present invention.

The load-bearing floor structure can be formed from a floor slab 11 and a ceiling slab 12 matching the story floor 2 and 3 and the ceiling surface on the underside of the story floor, and heat and sound insulated by means of an insulating layer 13 of conventional materials lying in between (FIG. 3). The thickness of the insulating layer 13 is adapted to the respective thickness 14 (FIG. 1) of the story floor 2 and 3. It is expedient for the floor slabs 11 and ceiling slabs 12 and the story floor 2 and 3 to be constructed from materials of a similar type so as to ensure an unobtrusive appearance which is as uniform as possible. Suitable materials are concrete, plaster, or similar slabs, and even slabs made of wood are suitable because they can be easily coated, particularly with plaster.

Architecturally attractive is a load-bearing story structure which serves as a skylight by admitting light in that, for example, the floor slab 11 and ceiling slab 12 consist of transparent materials. If the hoistway frame 7 with light-admitting load-bearing floor structure is used as a luminaire, at least one source of light must be provided in the hoistway frame 7 toward the hoistway penetration aperture 4 and 5. A means of electrical connection which is led for this purpose through the building up to the hoistway frame 7 can, for example, also be used to connect hoistway lighting if required when an elevator is installed.

The built embodiments of load-bearing floor structures as described can in each case either be assembled on the hoistway frame 7 in their individual component parts or assembled to an insertable frame 15 and as a prefabricated component suspended or inserted in the installed hoistway frame 16 which is partly shown in FIG. 2 and described by reference to FIG. 3. A prefabricated component of this type can, for example, be constructed as an aquarium that can withstand the weight of persons standing or walking on it.

Figure 2:
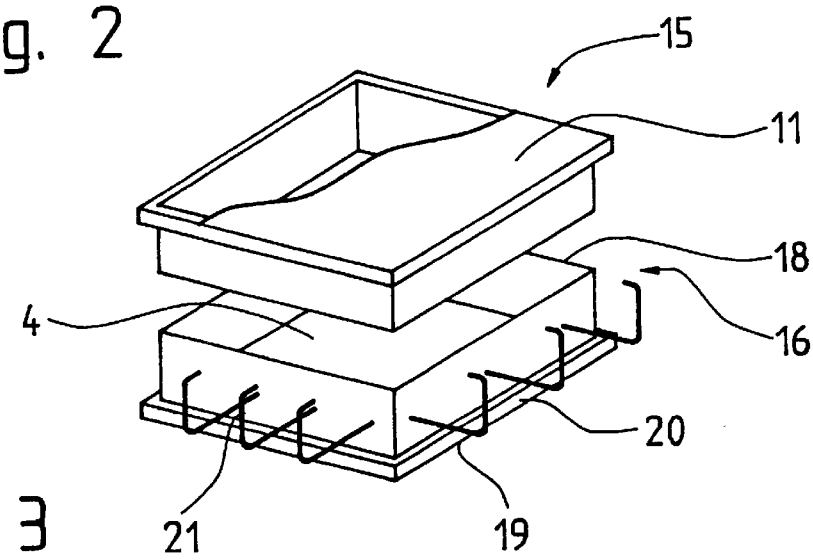
FIG. 2 is an exploded perspective view of a first embodiment of the hoistway frame according to the present invention with an insertable frame floor structure.

The embodiment shown in FIG. 2 comprises in essence a rectangular hoistway frame 16 constructed of sheet metal, and a complementary insertable frame 15, which can be inserted in a vertical direction in the hoistway penetration aperture 4 bounded by the hoistway frame 16 and which, as mentioned above, forms the floor structure.

The hoistway frame 16 is fabricated from a strip of sheet metal whose length corresponds to the perimeter of the hoistway penetration aperture 4 and 5 and to the cross-sectional area of the hoistway, and whose width is the same as the thickness 14 of the story floor 2 and 3. The sheet-metal strip is bent, folded over at the edges, and joined in usual fashion. In the vicinity of the upper 18 and lower 19 edges of the frame formed by the sheet-metal strip, essentially at a right angle facing outward, i.e. to the story floor 2 and 3, bent overlaps 20 stiffen the frame fabrication 16 and form supporting surfaces for precise fastening of the hoistway frame 16 in the ceiling formwork, as well as for positionally accurate insertion of the insertable frame 15.

An important characteristic are anchor hooks 21 evenly distributed over the outside of the frame perimeter, preferably in the area between the upper 18 and lower 19 edges of the frame, where they are permanently fastened and which serve to integrate the hoistway frame 16 into the reinforcement of the story floor. In the reinforced concrete construction, the anchor hooks 21 are embedded in concrete and together with the ceiling reinforcement serve to transmit the forces acting on the hoistway frame 16 into the hoistway floor 2 and 3. If the house has a wooden or composite construction the hoistway frame 16 is supported on load-bearing structural elements, as for example beams, girders. Anchoring elements suitable for this purpose are known to the specialist and can be used at his discretion.

As an interface between the building and the elevator that may have been installed, all important supporting and holding forces, whether those of the load-bearing floor structure or of the elevator installation itself, are transmitted via appropriately formed fastening and connecting elements into the hoistway frame 7, 16, 17 and 71 (described below) and from there into the building structure via a plurality of anchoring elements such as the tie rods 6, the anchor hooks 21 and the toothed metal plate 27 (described below).

A partial cutaway drawing of an embodiment of a hoistway frame 17 with insertable frame 15 which is adjustable to the respective thickness 14 of the story floor 2 and 3 is shown in FIG. 3. Except for the adjustable height of its frame 17, the shape of the hoistway frame 17 and the insertable frame 15 correspond to those of the embodiment shown in FIG. 2. On the plane defined by the hoistway frame 17 in the hoistway penetration aperture 4 and 5 it is split horizontally into two parts comprising a frame section 23 for anchorage in the story floor 2 and 3 and a frame section 22 to compensate the thickness 14 of the story floor. The two frame sections 22 and 23 engage each other in an interlocking manner along at least two parallel sides of the hoistway frame 17, in other words are hooked into each other. Within an adjustment range 24 given by the construction they can be moved relative to each other in a vertical direction, and thereby adjusted to the thickness 14 of the respective story floor 2 and 3. Set/clamping screws 25 secure the positions of the adjusted frame sections relative to each other.

The two frame sections 22 and 23 are composed of bent sheet-metal parts. The frame section 22 forms a U-shaped fold 26 to accept a fastening anchor in the form of a toothed metal plate 27. The toothed metal plate 27 is inserted in the fold 26 and fastened there by, for example, rivets 28 or screwed connections, and has convergent teeth 29 which face toward the story floor 2 and 3 and are anchored in cured concrete. Drilled holes 30 in the teeth 29 make integration into the reinforcing steel of the supporting structure possible. Additional vertically aligned apertures or drilled holes 32 through the fold 26 which projects horizontally into the hoistway penetration aperture 4 and 5 are provided, for example, to fasten the ceiling slab 12, spacing elements being inserted in between if necessary. The fold 26 also acts as a vertical stop for hoistway wall elements 31 (FIG. 1) which are inserted between the individual story floors after the insertable frame 15 is removed and which are fastened in the apertures and drilled holes 32 of the folds 26 with, for example, screwed connections as described further below. To align the wall elements 31, shims or adjusting screws can also be provided between the under edge of the wall and the fold 26.

Running at right angles to the fold 26 on both sides are a lower web 33 and an upper web 34 which together form a vertical frame plate of the frame section 23. The lower web 33 in particular serves as formwork when constructing the story floor 2 and 3 and forms the boundary of the side face of the hoistway penetration aperture 4 and 5 on the building side. The free end 35 of the lower web 33 is bent over at a right angle to the outer side of the hoistway frame 17 and thereby ensures that there is a clean boundary to the hoistway penetration aperture 4 and 5 and a secure seating for the hoistway frame 17. The free end of the upper web 34 is bent over at 180° into a vertically aligned fold 36, which is open at the bottom and into which the free lower web of the compensating frame section 23, which is bent into a fold 37 of complementary shape open at the top, engages. In the area immediately below the highest point of the fold 36, the upper web 34 is formed into a bead 38 projecting toward the hoistway penetration aperture 4 and 5 which compensates for dimensional inaccuracies and prevents the insertable frame 15 from jamming while being inserted, or becoming permanently seized in place.

The overlaps 39 and 40 of the mutually engaged folds 36 and 37 of the frame sections 22 and 23 determine the adjustment range 24 for the height of the hoistway frame. At the height of the edge of the overlap 39 there are set screws 25 which are screwed from the folded sheet of the frame section 22 lying opposite through threaded holes 41 and grip the overlap 39 of the other frame section 23. Instead of the set screws 25 there can equally well be screwed connections passing right through, which engage in the vertically oriented oval holes formed in the overlaps 39 and 40. The upper end of the compensating frame section 22 is bent outward at a right angle to form an edge 42. The insertable frame 15 can lie on the edge 42.

The insertable frame 15 is also composed of four pieces of sheet-metal section 43 each of which forms a frame section of the insertable frame 15 which is dimensioned to be complementary to the hoistway frame 17, and in particular to the hoistway penetration aperture 4 and 5 formed by the compensating frame section 22. The surface framed by the insertable frame 15 is covered by means of a floor slab 11 which itself is screw-fastened to, and flush with, the insertable frame 15 with the aid of appropriately formed holes.

As can be seen in FIG. 3, the rectangular insertable frame 15 forms a vertical apron 45 laterally adjoining which in each case is an edged sheet 50 having two steps formed of a first horizontal web 46 and a second horizontal web 47 and a first vertical web 48 and a second vertical web 49. The first horizontal web 46 determines the distance 51 from the first vertical web 48 to the apron 45, which is at least equal to the width of the fold 36. Further, the first horizontal web 46 is provided with a pattern of holes 52 which are threaded to accept screws screwed into them to fasten the floor slab 11. At the height of the upper edge of the apron 45, the first vertical web 48 joins the second horizontal web 47; the two together form the supporting surface onto which the floor slab 11 is fastened. Commencing at the second horizontal web 47 the second vertical web 49 has a length corresponding to the thickness 54 of the floor slab 11, flush with whose tread surface 55 it terminates in a horizontal flange 56. The horizontal flange 56 acts in conjunction with a supporting flange 57 parallel to it which is formed by a prolongation of the second horizontal web 47. The space between the horizontal flange 56 and the supporting flange 57 can serve, for example, to accommodate the edging of a floor covering laid on the story floor 2 and 3 taking the form of, for example, carpeting or parquetry. In this embodiment, the insertable frame 15 is supported in a swimming or floating manner and in consequence is able to follow settling and stretching movements of the floor covering relative to the story floor and thereby avoid the occurrence of stresses. This swimming support of the insertable frame 15 also ensures that no steps occur in the floor covering lying over its edges.

Figure 4:
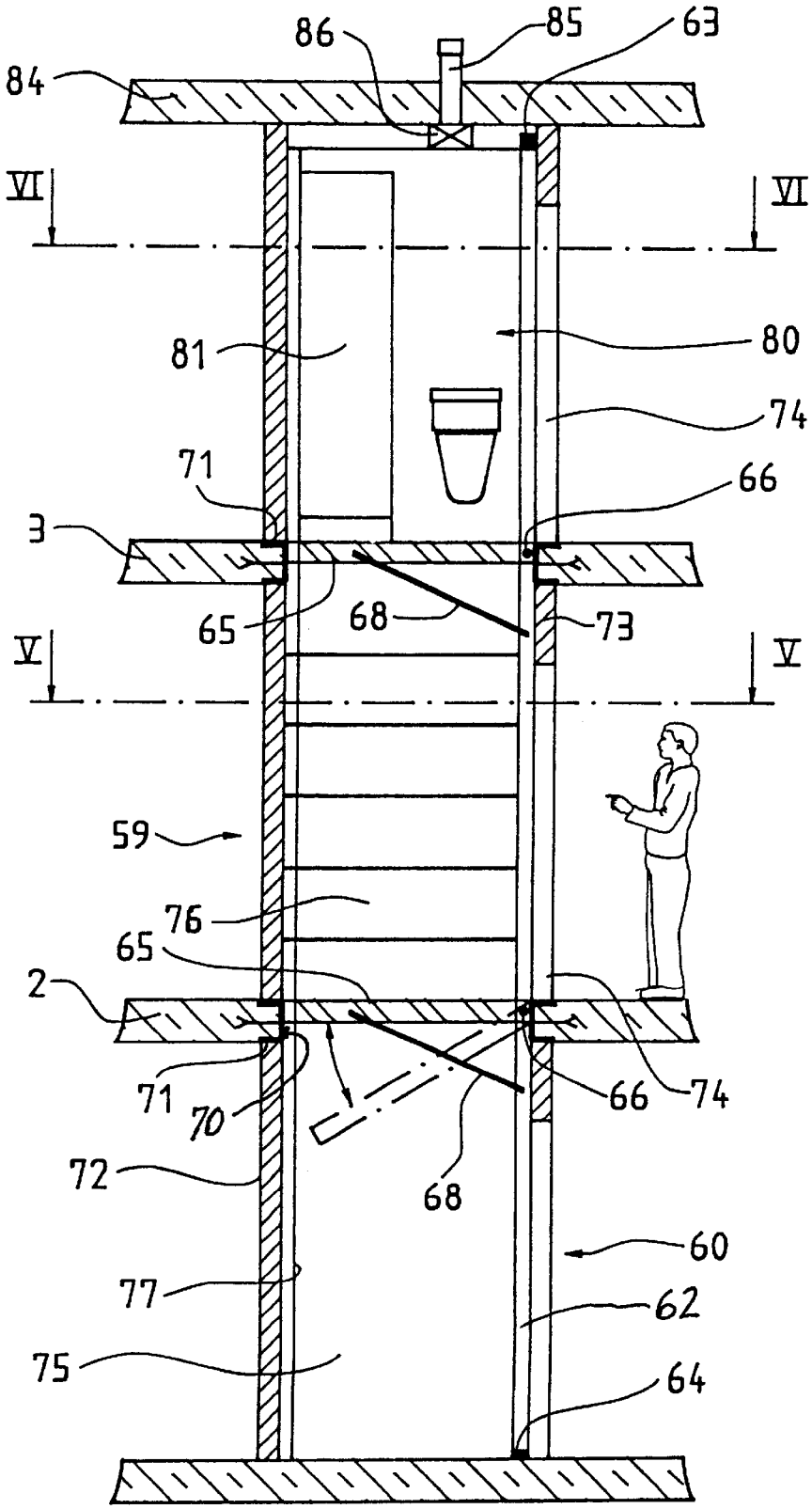
FIG. 4 is a vertical cross-sectional view similar to FIG. 1 showing an alternate embodiment of the elevator hoistway according to the present invention in which the load-bearing floor structure is attached in a swiveling manner to a self-supporting vertical structure.

Starting from an exposed, non-positively anchored hoistway frame 7, 16 and 17 as shown in FIGS. 1 and 4, hoistway walls 31 and 58 can be inserted into, or mounted on, the hoistway frame 17 thereby forming the boundary of the elevator hoistway 1 between the story floors 2 and 3. The hoistway walls 31 and 58 can already be inserted, preferably as prefabricated building elements, when the building is constructed and serve as room separators, or general space separators, or else only be put into place when an elevator is installed post-constructionally. It is also possible to insert only single walls 31 and 58 to correspond with the desired interior architecture of the building. As shown in FIG. 1, it is also possible for corresponding walls 58 to be fitted with a door which in case of need can serve as a hoistway door 74 (FIG. 4) allowing access to an elevator car or corresponding transportation equipment of the elevator installation. In both cases, the load-bearing floor structures 8 and 15 provided according to the invention on each story I, II and III permit temporary non-elevator-specific utilization of the cross-sectional surface of the hoistway, or section of the elevator hoistway, on each floor.

FIG. 4 shows an embodiment of the elevator hoistway 59 according to the invention having a self-supporting vertical structure 60 extending over three stories I, II and III comprising a left-hand guiderail 61 and a right-hand guiderail 62 which are preferably joined by an upper transverse strut 63 and a lower transverse strut 64 and to which a floor element 65 is attached at the height of each story floor. The floor element 65 comprises in essence a floor slab 11 of either monolithic or sandwich construction, or consisting essentially of a left-hand beam and a right-hand beam which are joined by a rear and a front lateral beam to form a frame and clad with suitable slabs. The longitudinal beams can consist of rectangular tubes into each of which a telescopic extension is movably inserted and which can be screw-fastened through oval holes to the longitudinal beams in many different positions.

The floor element 65, and particularly the left-hand and right-hand longitudinal beams, are fastened in a swiveling manner to the left-hand guiderail 61 and the right-hand guiderail 62 at attachment points 66 and 67. Fastening elements used for this purpose can be screws, bolts, secured pins, or similar. A specialist with knowledge of the invention may select another suitable structure known to him.

The floor element 65 attached in a swiveling manner is supported and held in its horizontally installed position by supporting struts 68 and 69 attached to the left-hand guiderail 61 and right-hand guiderail 62. The supporting struts 68 and 69 themselves are connected in a swiveling manner, for example, to the floor element 65 and the guiderails 61 and 62 respectively.

Here, the supporting struts 68 and 69 are constructed as adjustable tubes with right-hand/left-hand thread, so that by corresponding turning of the adjustable tubes about their longitudinal axis, the floor element 65 in its installed position can be raised or lowered and aligned flush with the respective floor level. Alternatives to this constructional embodiment of supporting struts 68 and 69 are know to the specialist; in fulfillment of the above function these can be used without detriment to the invention.

The vertical structure 60 described so far can be introduced into the elevator hoistway 59 already provided in the building as a pre-assembled component with the floor element not yet swiveled into horizontal position; it should preferably be fastened to the hoistway frame 71 and supported exclusively by force-transmitting fastening elements, for example screws 70. Finally, the swiveled load-bearing floor elements 65 permit the elevator hoistway 59 to be temporarily used for a different purpose, e.g. as residential space, until such time as an elevator may be post-constructionally installed.

A cladded elevator hoistway 59 is shown in outline in FIG. 4. There, by way of example, arranged on the vertical structure 60 are the hoistway wall cladding 72, and between the two guiderails a wall 73 with hoistway doors 74 which fulfill the requirements of DIN 4109. For accurate positioning of the hoistway wall cladding 72, the hoistway frames 71 are fitted with corresponding means of holding it. For example, as already described in relation to FIGS. 1 and 3, grooves and/or slots or similar are formed in the upper 18 and lower frame edge 19 or in the insertable frame 15.

Figure 5:
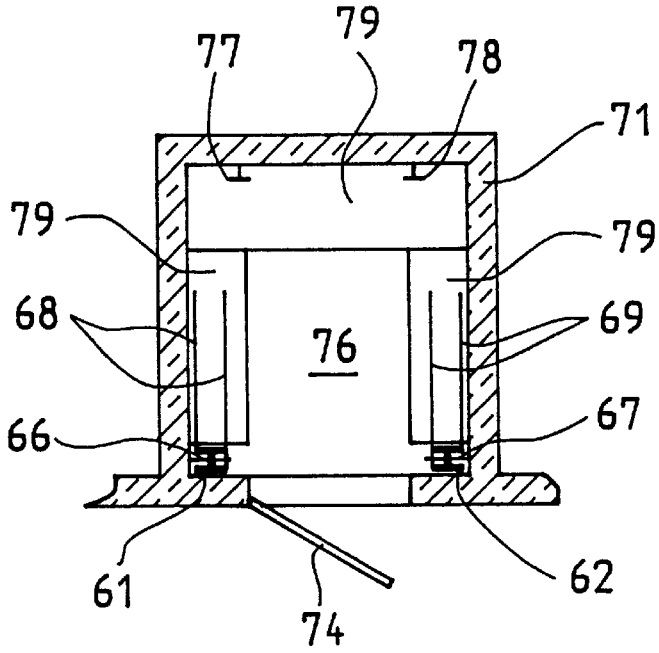
FIG. 5 is a cross-sectional view taken along the line V—V in FIG. 4.

In the first story 1 the elevator hoistway 59 is used as a storeroom 75. As shown in FIG. 5, in the area of the elevator hoistway 59 above this, and separated from it by the load-bearing floor element 65, in the second story II opposite the guiderails 61 and 62 and attached to the hoistway frame 71 over the height of the elevator hoistway 59, there are two supporting rails 77 and 78 on which shelves 79 rest in known manner, and further shelving modules are so mounted that this area can be used as a so-called walk-in cupboard 76. In the uppermost story III a sanitary cell 80 in the form of a prefabricated and pre-assembled module with integral floor element 65 is fastened to the vertical structure 60. Here too, the requisite integration of this sanitary cell 80 into the infrastructure of the residential house is by means of the hoistway frame 71. In the building, connections for domestic water supply and drainage and for the supply of electric current are led up to and into the hoistway frame 71. These can also be installed in the elevator hoistway 59 itself.

Figure 6:
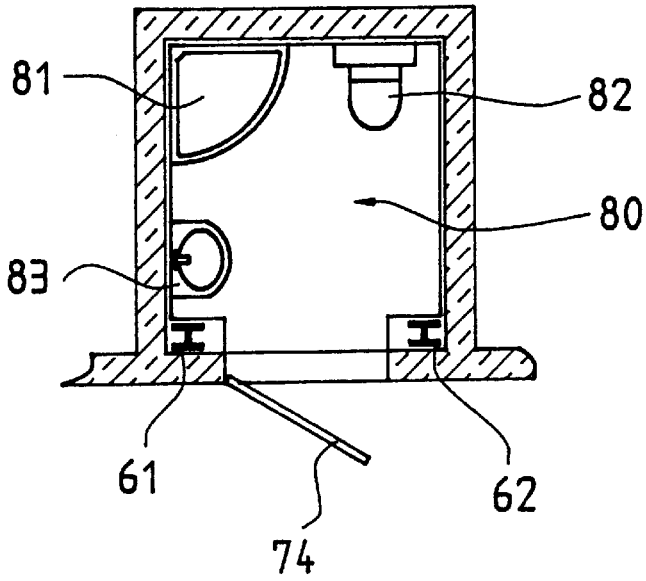
FIG. 6 is a cross-sectional view along the line VI—VI in FIG. 4.

The hoistway frame 71 forms a standardized interface for connecting the vertical structure 60 with the sanitary cell 80 and has the connecting elements needed for this purpose. There is walk-in access to the sanitary cell 80 from the corresponding story III via a hoistway door 74. As shown in FIG. 6, the sanitary cell 80 is equipped with a shower 81, a toilet 82, and a washbasin 83. The sanitary cell 80 is isolated from the elevator hoistway in a watertight manner. For this purpose it can take the form of a plastic construction. The sanitary cell 80 in the embodiment according to FIG. 6 is ventilated into the open air via a ventilation chimney 85 installed through the building cover 84. A fan 86 built into the ventilation chimney 85 actively supports the ventilation.

Should the need for installation of an elevator arise, the sanitary cell 80 can be disconnected from the hoistway frame 71 and the vertical structure 60 and removed from the elevator hoistway 59. The sanitary connection is shut off, whereas advantage is again taken of the possibility of electrical connection for the elevator-specific utilization of the elevator hoistway 59. The vertical structure 60 itself then serves as a support and guidance structure of the elevator for a drive and an elevator car that can be moved by the drive along the guiderails 61 and 62.

Instead of the temporary change in use of the vertical structure 60 described above, it can also be used as an interface for various leisure installations such as, for example, a climbing wall, fitness apparatus, etc. Furthermore, in the elevator hoistway 59 anticipatorily installed in a residential house, a system of shelves circulating according to the paternoster system can be provided, the guiderails 61 and 62 serving to guide the shelf loop.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator hoistway for a multistoried building for creating a vertical travel path for an elevator installation extending through at least one story floor having a hoistway penetration aperture formed therein, comprising:

a hoistway frame attached to the story floor and bounding the hoistway penetration aperture, said hoistway frame being solely supported by the story floor; and a load-bearing floor structure detachably connected to the hoistway frame and removably covering the hoistway penetration aperture.

2. The elevator hoistway according to claim 1 wherein said load-bearing floor structure is aligned flush with an upper surface the story floor.

3. The elevator hoistway according to claim 1 wherein said hoistway frame is adjustable in a vertical direction to a thickness dimension of the story floor.

4. The elevator hoistway according to claim 1 wherein said hoistway frame includes a plurality of anchoring elements for fastening and connecting said hoistway frame to the story floor for transmitting forces acting on said hoistway frame into the story floor.

5. The elevator hoistway according to claim 1 wherein said load-bearing floor structure is assembled into an insertable frame and said insertable frame is inserted into said hoistway frame.

6. The elevator hoistway according to claim 1 including a vertical structure extending over the vertical travel path and supported on said hoistway frame and wherein said load-bearing floor structure is detachably connected to said vertical structure.

7. The elevator hoistway according to claim 6 wherein said load-bearing floor structure is attached in a swiveling manner to said vertical structure.

8. The elevator hoistway according to claim 6 wherein said load-bearing floor structure is part of a space cell which is at least partially enclosed and which is detachably fastened to said vertical structure.

9. The elevator hoistway according to claim 1 wherein said hoistway frame is configured to connect to at least one hoistway wall.

10. An elevator hoistway for a multistoried building for creating a vertical travel path for an elevator installation extending through at least one story floor having a hoistway penetration aperture formed therein, comprising:

a hoistway frame attached to the story floor and bounding the hoistway penetration aperture, said hoistway frame having a height approximately equal to a thickness of the story floor;

a plurality of anchoring elements attached to said hoistway frame for fastening and connecting said hoistway frame to the story floor; and a load-bearing floor cover detachably connected to the hoistway frame and removably covering the hoistway penetration aperture whereby said floor cover serves as part of the story floor until removed when an elevator is installed in the elevator hoistway.

11. The elevator hoistway according to claim 10 wherein said anchoring elements are at least one of tie rods, anchor hooks and toothed metal plates.

12. An elevator hoistway for a multistoried building for creating a vertical travel path for an elevator installation extending through at least one story floor having a hoistway penetration aperture formed therein, comprising:

a hoistway frame attached to the story floor and bounding the hoistway penetration aperture, said hoistway frame having a height approximately equal to a thickness of the story floor; and a load-bearing floor cover detachably connected to the hoistway frame and removably covering the hoistway penetration aperture whereby said floor cover serves as part of the story floor until removed when an elevator is installed in the elevator hoistway.

* * * * *